United States Patent [19]

Crankshaw et al.

[11] 4,194,640

[45] * Mar. 25, 1980

[54] VIAL AND CLOSURE

[75] Inventors: Gary K. Crankshaw, Kalamazoo; George W. Braymer, Ross Township, Kalamazoo County, both of Mich.

[73] Assignee: The Upjohn Company, Kalamazoo, Mich.

[ * ] Notice: The portion of the term of this patent subsequent to May 16, 1995, has been disclaimed.

[21] Appl. No.: 903,662

[22] Filed: May 8, 1978

Related U.S. Application Data

[63] Continuation-in-part of Ser. No. 794,348, May 6, 1977, Pat. No. 4,089,432.

[51] Int. Cl.[2] ..... B65D 81/32

[52] U.S. Cl. ..... 215/6; 128/272.1; 206/219; 215/249; 215/253; 215/258; 215/301; 215/320

[58] Field of Search ..... 215/6, 247, 249, 251, 215/253, 231, 258, 301, 320, DIG. 3; 129/272, 272.1; 206/219

[56] References Cited

U.S. PATENT DOCUMENTS

| | | | |
|---|---|---|---|
| 2,009,738 | 7/1935 | Kuenstler | 215/258 |
| 2,869,745 | 1/1959 | Lockhart | 215/247 |
| 2,908,274 | 10/1959 | Bujan | 215/247 |
| 3,056,522 | 10/1962 | Johnson, Jr. | 215/253 |
| 3,087,638 | 4/1963 | Loper | 215/DIG. 3 |
| 3,439,823 | 4/1969 | Morane | 206/221 |
| 3,464,414 | 9/1969 | Sponnoble | 206/219 |
| 3,785,481 | 1/1974 | Allet-Coche | 128/272.1 |
| 3,874,541 | 4/1975 | Lagneaux et al. | 215/253 |
| 3,977,555 | 8/1976 | Larson | 215/247 |

*Primary Examiner*—Ro. E. Hart

*Attorney, Agent, or Firm*—Blanchard, Flynn, Thiel, Boutell & Tanis

[57] ABSTRACT

A closure structure for a vial or container, preferably of the two-compartment type, wherein lyophilized medication is contained in one compartment and a solvent is contained in the other compartment with a displaceable, moisture-proof plug disposed between the two compartments. The closure structure is comprised of a stopper which is partially inserted into the neck of a vial and is covered by a cap member having a fastening portion for securing the cap member to the open end of the vial neck and a sleeve portion of reduced diameter which snugly surrounds the protruding portion of the stopper and is disconnectible from the fastening portion in order to move with the protruding portion of the stopper into the neck of the bottle under manually applied pressure. A dust shield is secured to the free end of the sleeve portion and is preferably removed after which the needle of a syringe can be inserted through the stopper to communicate with the interior of the vial.

10 Claims, 11 Drawing Figures

VIAL AND CLOSURE

CROSS REFERENCE TO RELATED APPLICATION

This application is a continuation-in-part of our copending application Ser. No. 794,348, filed May 6, 1977, now U.S. Pat. No. 4,089,432.

BACKGROUND OF THE INVENTION

This invention relates in general to a closure structure for a vial whereby accidental contamination of the contents of the vial is positively prevented and, more particularly, to a closure structure for a two-compartment vial in which a lyophilized medication and a solvent can be held in complete independence from each other until it becomes desirable to use the medication.

Two-compartment vials of the kind disclosed herein have been made and have been in common use for packaging and mixing medications for many years. However, such use has been frequently and constantly marked by problems. For example, early two-compartment vials were equipped with rubber center plugs which did not furnish moisture-proof barriers. Accordingly, the resultant seepage of the solvent into the lyophilized medication prevented the package from having the desired shelf-life. This problem was eventually overcome after considerable experimentation by means of the structure disclosed in U.S. Pat. No. 3,464,414.

However, a further problem continued to persist and it concerned the closure structure. More specifically, in order to dislodge the center plug from between the compartments so that the solvent can be mixed with the medication, it is necessary to depress the stopper which is partially disposed in the neck of the vial and projects somewhat beyond said neck. The problem is that the projecting portion of the stopper tends to bulge radially outwardly when it is urged into the neck and therefore positively and vigorously opposes insertion of the stopper into the neck. Thus, the harder the stopper is pushed into the bottle, the more aggravated the problem becomes. If the stopper is made from less flexible material, in order to minimize the bulging, then leakage of the solvent past the stopper readily occurs. That is, it is extremely difficult to hold close tolerances in the inside diameter of the neck of the vial and the outside diameter of the stopper, within reasonable cost limitations. By using a relatively soft rubber stopper, having an oversized diameter, it is possible to absorb large tolerances and still prevent leakage.

Because of the problems encountered with bulging stoppers, many adverse results occur. Occasionally, the force exerted on the stopper becomes so excessive that the stopper is displaced completely through the neck and into the solvent thereby contaminating it. Occasionally, persons with relatively weak hands are obliged to press contaminated articles, such as pencils, pens, screw drivers and the like, against the outer end of the stopper in an effort to force it inwardly. Occasionally such instruments cause damage to the vial and/or to the hand of the user, or push the stopper completely into the vial compartment.

In existing closure structures for the same purpose, the outer free end of the stopper is often exposed to atmosphere, hence contamination, which can contaminate the needle of the syringe as it is moved through the stopper into the vial to withdraw the mixed materials therein. That is, the syringe must pass through the surface of the stopper which has been manually engaged by the hand of the user.

Finally, existing closure structures of this type are usually in two pieces, one comprising a removable stopper cap and the other comprising a ferrule which prevents accidental removal of the stopper from the vial. Usually, these two parts are made from dissimilar materials and assembled in two steps.

Accordingly, a primary object of this invention is the provision of a closure structure including a relatively soft and resiliently flexible stopper and a cap member having a fastening portion mounted upon the neck of a vial and a reduced portion closely surrounding the part of the stopper extending out of the neck of the vial, said reduced portion being movable with the stopper relative to the fastening portion and the neck of the vial.

A further object of this invention is the provision of a closure structure, as aforesaid, wherein the fastening portion is positively prevented from accidentally dislodging itself from the neck of the container and wherein the reduced portion of the cap has means cooperable with the fastening portion for holding said reduced portion within the neck of the container after it is pressed thereinto.

A further object of this invention is the provision of a closure structure, as aforesaid, having a removable sealing member closing the outer open end of said cap means.

Other objects and purposes of this invention will become apparent to persons familiar with this type of equipment upon reading the following description and examining the accompanying drawings, in which.

The following United States patents are briefly distinguished from the invention as follows:

The Lockhart U.S. Pat. No. 2,695,614 discloses a two-compartment vial having a resiliently flexible stopper, but there is no rigidifying sleeve therearound.

The Bujan U.S. Pat. No. 2,908,274 discloses a resilient stopper surrounded by a sleeve, but the sleeve is independent and spaced from the bottle-engaging ferrule so that contamination can readily occur therebetween. Because of its particular structure, assembly of the parts is considerably more complicated in Bujan than in the subject invention.

In the Hayes U.S. Pat. No. 3,073,471, the embossment does not encase any part of the stopper and is merely disposed of after it is broken loose from the ferrule.

In the Parker U.S. Pat. No. 3,081,899, there is no resiliently flexible stopper encased by a sleeve.

In Larson U.S. Pat. No. 3,940,003, there is a limit stop on the stopper engageable with the sleeve, but there is no stop on the sleeve engageable with the ferrule as in Applicant's invention.

Accordingly, it is believed that the foregoing patents, as well as the aforesaid U.S. Pat. No. 3,464,414, are distinguishable from the claims in this application.

Figure 1:
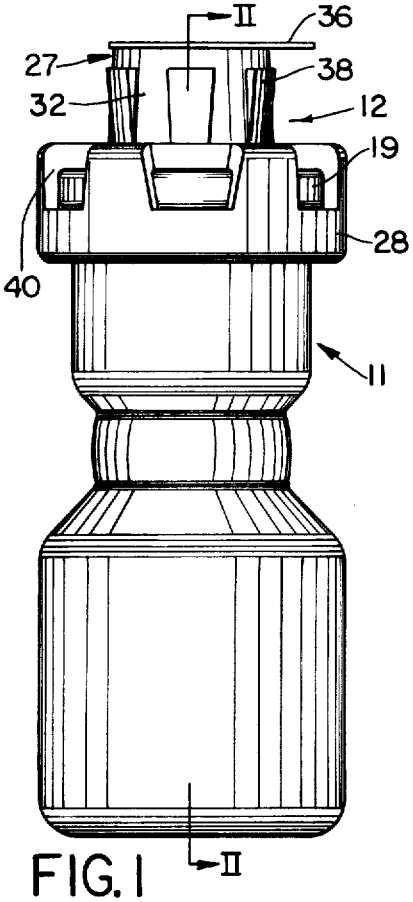
FIG. 1 is a side elevational view of a vial or container equipped with a closure structure embodying the invention.

For convenience in description, only, the terms "upper", "lower" and words of similar import will have reference to the invention and parts thereof as appearing in FIG. 1. The terms "inner", "outer" and derivatives thereof will have reference to the geometric center of said container and parts thereof.

SUMMARY OF THE INVENTION

The objects and purposes of the invention, including those set forth above, have been met by providing a closure structure for a two-compartment vial wherein a substantially cylindrical, elastomeric stopper is partially inserted into the neck of the vial and then surrounded by a cap means comprising a first portion secured to the neck and a second reduced portion snugly surrounding the outer portion of the stopper which extends from the vial.

DETAILED DESCRIPTION

The two-compartment vial 11 and closure structure 12, shown in FIG. 1, which illustrates a preferred embodiment of the invention, are substantially permanently interconnected. The vial 11 has a neck 13, a lower compartment 14 and an upper compartment 16, which compartments are separated by a constriction 17 into which a moisture barrier or plug 18 (FIG. 2) is inserted during the filling operation. The neck 13, in this embodiment of the invention, is an upward extension of the upper compartment 16 and, therefore, of substantially the same diameter. However, the neck may under some circumstances be of a reduced diameter. The neck 13 had an outwardly projecting, annular rim 19 encircling its upper end.

In one particular utilization of the invention, a lyophilized medication is placed in the lower compartment 14 and the upper compartment 16 is filled with a solvent.

The closure structure 12 is comprised of a resiliently flexible stopper 20 which is preferably an elongated cylinder fabricated from an elastomer which is impervious to the solvent contained in the upper compartment. Said stopper has a deep conical recess 22 opening into the upper compartment so that a needle 23 (FIG. 6) of a conventional syringe can be inserted axially through the stopper with relative ease.

The stopper 20 has a portion 24 of increased diameter which is disposed within the neck 13 of the container. In order to improve the sealing qualities between said enlarged portion 24 and the neck 13, said enlarged portion is provided with a plurality, here three, of spaced annular ridges 26. Said ridges can be somewhat larger in diameter than said enlarged portion could be if it were of a solid peripheral surface, without increasing, and in some cases actually reducing, the frictional engagement between the ridges of the large portion 24 of the stopper 20 and the internal surface of the neck 13.

The cap member 27, which partially surrounds the stopper 20, may be made by molding from a plastic, such as polyethylene, so that it has some resilience and some flexibility, but is relatively rigid. The cap member 27 has a lower skirt 28 which extends downwardly over and around the upper end of the neck to a plane somewhat below the lower edge of the rim 19.

Figure 2:
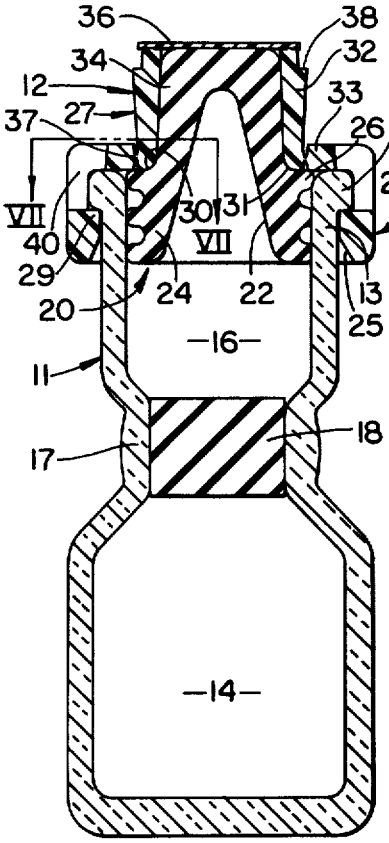
FIG. 2 is a sectional view taken along the line II—II in FIG. 1.
Figure 4:
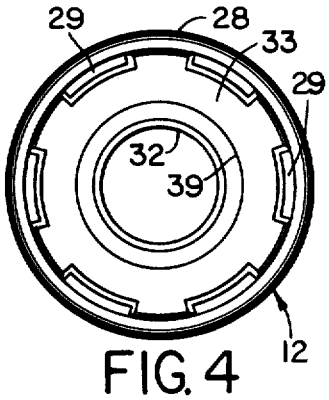
FIG. 4 is a bottom view of the cap member of the closure structure.

The skirt 28 has a plurality of substantially uniformly spaced, radially inwardly extending projections 29 (FIGS. 4 and 5), the inner surfaces of which define a circle having a diameter somewhat less than the outside diameter of said rim 19. The projections 29 are positioned below openings 40 formed in the skirt 28, as shown in FIGS. 1 and 2. The cap member 27 has a sleeve 32 of reduced diameter and a flat, radially disposed ring 33 which extends between and is connected to the lower edge 31 of the sleeve 32 and the upper edge of the skirt 28. The ring 33 has an inside diameter smaller than the outside diameter of the stopper lower portion, whereby accidental removal of the stopper from the vial 11 is positively opposed.

The distance between the inner or lower surface of the ring 33 and the upper edges of said projections 29 on said skirt 28 is approximately equal to the thickness of said rim 19 in a direction axially of the container. Thus, when the lower part of the skirt 28 is forced downwardly over the rim 19, said rim is thereafter firmly gripped between said projections 29 and said ring 33, whereby to strongly resist separation of the cap member 27, hence the entire closure 12, from the container 11. The lower, inner edges 25 of the projections 29 are tapered to facilitate mounting of the skirt 28 on the vial neck.

Figure 5:
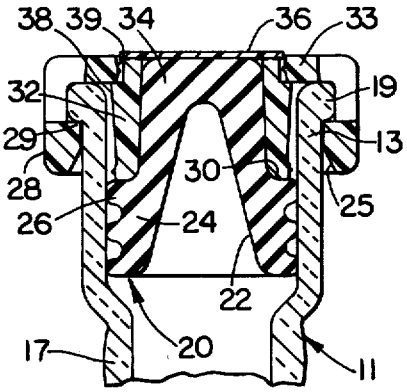
FIG. 5 is a sectional view of the closure member and neck portion of the container with the stopper portion of the closure structure depressed into the neck.
Figure 6:
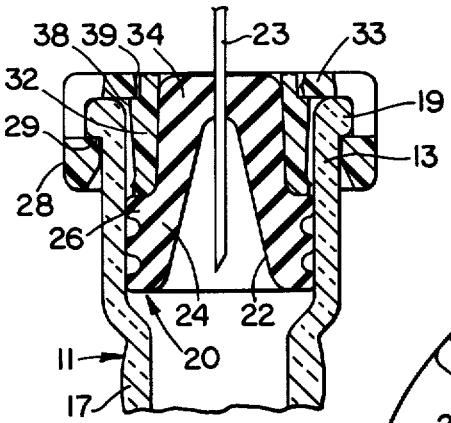
FIG. 6 is a sectional view similar to FIG. 5 showing the dust shield removed and the needle of a syringe extending through the stopper for communication with the interior of the container.

The sleeve 32 closely and snugly surrounds the upwardly projecting portion 34 of the stopper 20, as shown in FIGS. 2, 5 and 6. An upwardly facing shoulder 30 is provided between the upper portion 34 and lower portion 24 of said stopper 20.

The outer axial end of the sleeve 32 is engaged by a dust shield 36, which may be removably secured thereto, thereby substantially totally enclosing the stopper within said cap member and the upper end of the vial 11 when the closure 12 is mounted on the vial. Under some circumstances, it may be desirable to attach the dust shield permanently to the sleeve and render it readily perforable by a syringe needle.

Figure 7:
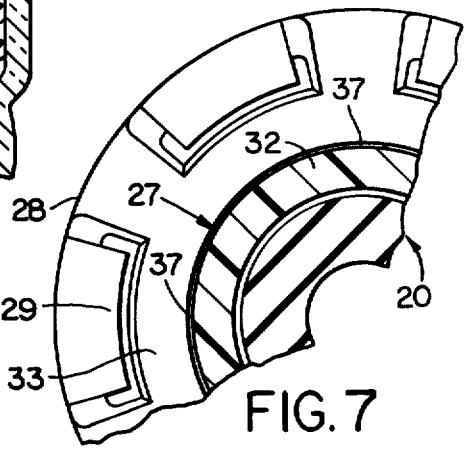
FIG. 7 is a fragmentary sectional view taken along the line VII—VII in FIG. 2 with the container removed.
Figure 10:
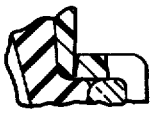
FIG. 10 is a modified fragment of FIG. 2.
Figure 9:
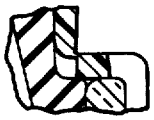
FIG. 9 is a modified fragment of FIG. 2.
Figure 8:
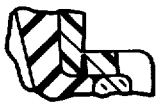
FIG. 8 is a modified fragment of FIG. 2.

The sleeve 32 (FIGS. 2 and 7) is connected to the ring 33 by a plurality, such as four, small fracturable connectors 37 which can be readily manually broken by pressing the stopper 20 and sleeve 32 toward the vial 11. The connectors 37 may be located intermediate the upper and lower surfaces of the ring 33, as shown in FIG. 2. Also, said connectors may be located adjacent the upper surface (FIGS. 8 and 9) or adjacent the lower surface (FIG. 10) of said ring 33.

Figure 11:
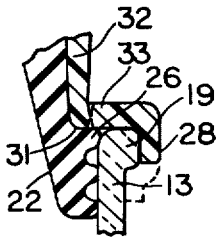
FIG. 11 is a modified fragment of FIG. 2.

The skirt 28 of the cap, instead of being mechanically resiliently snapped below the rim 19, can be formed as shown in FIG. 11. The skirt 28, in this embodiment, does not project under the rim 19, but rather is securely attached to the outer side surface of the rim, being in frictional gripping engagement therewith, as by being spun therearound or adhesively bonded thereto.

As a further alternative, instead of snapping the preformed skirt 28 under the rim 19 as in FIG. 2, the skirt 28 could be mechanically crimped or spun under the rim 19 to lock the cap thereto, as shown by dotted lines in FIG. 11.

Figure 3:
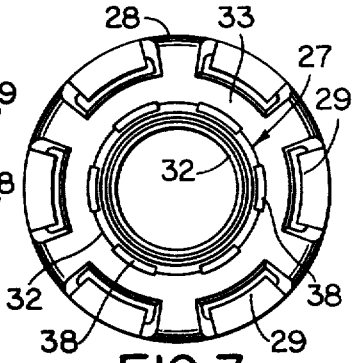
FIG. 3 is a top view of the closure structure with the dust shield removed.

The outside surface of the sleeve 32 (FIGS. 1 and 3) is provided with a plurality of parallel and substantially uniformly spaced ribs 38 which extend axially of and converge with the sleeve toward the skirt. The diameter of the circle defined by the lower ends of said ribs 38 is approximately equal to the inside diameter of the circular opening 39 in the ring 33. However, the circle defined by the upper ends of said ribs 38 is somewhat larger than the inside diameter of said ring opening 39. Thus, when the stopper 20 and sleeve 32 are moved toward the vial 11, the upper ends of said ribs 38 can slide through the opening 39 and lodge beneath the ring 33 so as to hold said sleeve 32 against upward movement away from the container, thereby holding the stopper against movement upwardly from the vial 11. Accordingly, the package is rendered incapable of reuse.

OPERATION

The operation of the aforesaid structure is probably apparent from the foregoing description. However, a brief summary of such operation will now be given.

The chamber 14 of vial 11 is filled with a lyophilized or powdered medication (not shown), a center plug 18 is inserted in the constriction 17 and a solvent (not shown) is placed in the chamber 16, all in a well-known, conventional manner. Thereafter, the stopper 20 is inserted into the neck 13 and, following this, the cap member 27 is placed on the vial, surrounding the stopper. The tapered edges 25 permit the forcing of the skirt 28 downwardly over the rim 19. However the fastening of the skirt to the vial can be accomplished by other techniques.

The ring 33 overlays the shoulder 30 on the stopper 20, thereby preventing accidental removal of the stopper from the vial.

The dust shield 36 may be secured to the upper open end of the sleeve 32 in sealed relationship, either before or after the cap member is attached to the vial 11.

When it becomes desirable to use the medication, the vial 11 is gripped within the hand so that the thumb can press against the upper end of the sleeve 32 and dust shield 36. By urging the sleeve and shield toward the vial with the thumb, the connectors 37 are fractured and the stopper portion 34 and sleeve 32 are then moved into the vial neck 13. Such movement of the stopper 20 creates hydraulic pressure within the upper compartment 16 which forces the plug 18 out of the constriction 17 so that the solvent can move into the lower compartment 14 and mix with the medication. The sleeve is depressed into the vial until the upper ends of the ribs 38 are locked beneath the shoulder 33.

The dust shield 36 can then be removed from the sleeve 32 after which the syringe needle 23 is inserted through the stopper, the recess 22 and into the upper compartment 16 of the vial from which the dissolved medication can be removed while the vial is in an inverted position. The syringe can then be removed from the stopper 20 and the self-sealing nature of the stopper will prevent leakage, if some medication remains.

Because the lower end 31 of the sleeve 32 bears against the shoulder 30 on stopper 20, at least some of the force applied by the thumb to the upper ends of the sleeve and stopper is transferred directly to the lower portion of the stopper, which is disposed within the vial. Moreover, the sleeve 32 prevents lateral bulging of the upper portion 34 of the stopper.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a two-compartment container having a constriction between the two compartments capable of receiving a removable plug which provides a liquid-tight barrier between the two compartments, said container having a neck communicating with one of said compartments and said neck having an annular rim adjacent the free end thereof, and a closure structure for said neck, said closure structure comprising:

a resiliently flexible, substantially cylindrical stopper having a first portion with an outside diameter slightly larger than the inside diameter of said neck and snugly receivable into said neck and a second portion of reduced diameter projecting beyond the free end of said neck;

resiliently flexible cap means of substantially circular cross section having a fastening portion telescopically receivable onto the free end of said neck, said fastening portion having means for gripping said rim, said fastening portion including annular means overlying the upper edge of the stopper first portion so as to oppose its removal from the vial, and said cap means having a sleeve portion of reduced diameter snugly but slidably receivable onto the second portion of said stopper, said sleeve portion being attached to said fastening portion by manually fracturable means, said sleeve portion being slidably receivable with the second portion of said stopper through said annular means and into said neck by the application of force urging said sleeve portion toward said container;

cooperable lock means on said sleeve portion and said annular means for positively opposing movement of said sleeve portion out of said vial after said sleeve portion has been moved a preselected distance through said annular means; and means attached to said outer end of said sleeve portion of said cap means for closing the outer end thereof.

2. A closure structure according to claim 1, wherein said lock means comprises the lower inner edge of said annular means and a plurality of axially elongated and parallel projections on the outer surface of said sleeve portion, said projections diverging upwardly from said sleeve portion to form abutments at their upper ends receivable beneath said annular means for locking engagement therewith.

3. A closure structure according to claim 1, wherein said cap means is formed in one piece from a plastic material and said fracturable means comprises a plurality of spaced elements.

4. In combination, a two-compartment mixing vial having a constriction between the two compartments, a removable plug disposed within the constriction to provide a liquid-tight barrier between the two compartments, said vial having a neck at one end thereof for defining an opening communicating with one of said compartments, said neck defining an annular rim adjacent the free end thereof in surrounding relationship to said opening, and a closure structure attached to said vial for closing the opening in said neck, said closure structure including a substantially cylindrical stopper disposed within said neck, said stopper including a first substantially cylindrical portion of a resiliently flexible material and having an outside diameter which is normally slightly larger than the inside diameter of said neck, said first cylindrical portion being snugly and sealingly received within said neck, said stopper including a second portion of reduced diameter projecting outwardly beyond the free end of said neck and thereby forming a shoulder at the junction between said first and second portions, comprising the improvement wherein said closure structure includes:

cap means having a fastening portion telescopically received onto and around the annular rim located adjacent the free end of said neck, said fastening portion grippingly engaging said rim for fixedly connecting said cap means to said vial, said fastening portion including a projecting portion disposed adjacent the free end of said neck and projecting radially inwardly thereof so as to overlie said shoulder to oppose the removal of said first stopper portion from said neck;

said cap means also having a sleeve portion of reduced diameter snugly received on the second portion of said stopper in surrounding relationship thereto, and manually fracturable means integrally and fixedly connected between said sleeve portion and said projecting portion, said sleeve portion being slidably receivable with said second stopper portion into the neck of said vial by the application of a force which urges said sleeve portion toward said vial to cause breaking of said fracturable means followed by slidable displacement of said sleeve portion and said second stopper portion into said neck; and cooperable lock means on said sleeve portion and said fastening portion for positively opposing movement of said sleeve portion out of said neck after said sleeve portion has been moved a preselected distance into said neck.

5. A combination according to claim 4, including means attached to the outer end of said sleeve portion for sealingly closing the outer end of said cap means so that said stopper is sealingly isolated from the surrounding environment.

6. A combination according to claim 4, wherein the projecting portion of said fastening portion comprises annular platelike means positioned so as to overlie the axial free end of said neck, said platelike means projecting radially inwardly to overlie the shoulder of said stopper, said sleeve portion being sized to axially slidably move through said annular platelike means when said sleeve portion is pushed into said neck, and said locking means including abutment means formed on said sleeve portion at a location normally spaced upwardly a substantial distance above said annular platelike means, said manually fracturable means including a plurality of thin angularly spaced breakable webs integrally connected between the inner edge of said annular platelike means and said sleeve portion adjacent the lower end thereof.

7. A combination according to claim 4, wherein the inside diameter of said neck and said one compartment of said vial are substantially identical.

8. A combination according to claim 4, wherein the fastening portion of the cap means is adhesively secured to the rim so as to be grippingly engaged therewith.

9. A combination according to claim 4, wherein the fastening portion has a ring-shaped part which exteriorly surrounds the rim and is in frictional gripping engagement with an annular exterior peripheral sidewall of the rim.

10. A combination according to claim 4, wherein shield means is removably attached to the outer end of said sleeve portion for sealingly closing the outer end of said cap means so that said stopper is sealingly isolated from the surrounding environment.

* * * * *